US007963343B1

(12) United States Patent
Hopkins

(10) Patent No.: US 7,963,343 B1
(45) Date of Patent: Jun. 21, 2011

(54) AUTOMATIC FIRE EXTINGUISHING SYSTEM FOR AN EXISTING CHRISTMAS TREE AND ASSOCIATED METHOD

(76) Inventor: James Hopkins, Annapolis, MD (US)

( * ) Notice: Subject to any disclaimer, the term of this patent is extended or adjusted under 35 U.S.C. 154(b) by 312 days.

(21) Appl. No.: 12/221,749

(22) Filed: Aug. 6, 2008

Related U.S. Application Data

(60) Provisional application No. 60/963,461, filed on Aug. 6, 2007.

(51) Int. Cl.
*A62C 37/00* (2006.01)

(52) U.S. Cl. ..... 169/56; 169/13; 169/54; 169/61; 340/628; 340/632

(58) Field of Classification Search ..... 169/51, 169/56, 60, 61, 66, 13, 54; 340/628, 632
See application file for complete search history.

(56) References Cited

U.S. PATENT DOCUMENTS

| | | | | | |
|---|---|---|---|---|---|
| 2,522,020 | A * | 9/1950 | Deyo | ..... | 169/58 |
| 2,871,952 | A * | 2/1959 | Doak | ..... | 169/26 |
| 3,132,695 | A * | 5/1964 | Peltier | ..... | 169/26 |
| 3,171,493 | A * | 3/1965 | Barr | ..... | 169/57 |
| 3,196,953 | A * | 7/1965 | Young | ..... | 169/19 |
| 3,783,946 | A * | 1/1974 | Petrinec et al. | ..... | 169/61 |
| 5,018,586 | A * | 5/1991 | Cawley et al. | ..... | 169/56 |
| 5,031,702 | A * | 7/1991 | Trumbach | ..... | 169/61 |
| 5,040,610 | A * | 8/1991 | Blanchong | ..... | 169/56 |
| 6,003,610 | A * | 12/1999 | Kordes | ..... | 169/61 |
| 6,021,852 | A * | 2/2000 | Barnett et al. | ..... | 169/58 |
| 6,075,447 | A * | 6/2000 | Nightingale et al. | ..... | 340/628 |
| 6,244,353 | B1 * | 6/2001 | Greer | ..... | 169/61 |
| 6,382,582 | B1 * | 5/2002 | Brown | ..... | 248/521 |
| 7,679,521 | B1 * | 3/2010 | Gavia et al. | ..... | 340/628 |

* cited by examiner

*Primary Examiner* — Dinh Q Nguyen
*Assistant Examiner* — Trevor E McGraw

(57) ABSTRACT

A Christmas tree fire prevention device preferably includes an air-pressurized reservoir containing fire-retardant agent and a mechanism for automatically discharging the fire-retardant agent. The discharging mechanism may be connected to the reservoir via a flexible hose may also be removably attached to the apex of an existing Christmas tree and camouflaged as a holiday decoration. A mechanism for automatically emitting an alarm signal when the automatic fire-retardant agent discharging mechanism is activated may further be included. The discharging mechanism may include a valve with a metal-alloy plug which has a relatively low melting point. Flame heated air preferably causes the plug to melt and activates the discharging mechanism, which ejects the plug from the valve. The pressurized fire-retardant may then egress through the valve, deflect off a guard located on top of the discharging mechanism, and cover the Christmas tree.

14 Claims, 9 Drawing Sheets

AUTOMATIC FIRE EXTINGUISHING SYSTEM FOR AN EXISTING CHRISTMAS TREE AND ASSOCIATED METHOD

CROSS REFERENCE TO RELATED APPLICATIONS

This application claims the benefit of U.S. Provisional Application No. 60/963,461, filed Aug. 6, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to fire extinguishing devices and, more particularly, to a Christmas tree fire extinguishing device for reducing a likelihood of fire damage to an existing Christmas tree and surrounding objects.

2. Prior Art

It is known that Christmas trees and especially those comprised of a live tree present a fire hazard. As such, devices for detecting a fire condition have been introduced in the prior art. These devices may either sound an alarm or activate a fire extinguishing material into the tree, or both. Some devices are disguised as tree ornaments. However, these devices, simply because of their limited size, are limited to being strictly alarms such as a smoke detector or to holding and discharging relatively small quantities of fire extinguishing material, which limits their effectiveness.

One prior art example shows a fire extinguishing device that incorporates a tank of pressurized fire extinguishing material that is ejected to a spray nozzle at the top of the tree upon fusing of an element. While more effective than discreet ornament type devices, the larger exposed tank is aesthetically undesirable. Furthermore, it is always desirable to provide for extinguishing devices that provide increased fire extinguishing capability and efficiency.

U.S. Pat. No. 3,783,946 to Petrinec discloses a self-contained fire extinguishing system that includes a quantity of fire extinguishing material under pressure which is connected through conduit means to one or more dispensing nozzles. A control valve mechanism is interposed in a conduit mechanism and is initially energized to cause the extinguishing material to pass through the valve during a first initial condition, and thereafter to cause subsequent sequential energization of the flow control valve to insure that fire extinguishing characteristics are maintained for a predetermined time. Unfortunately, this prior art example fails to provide a fire extinguisher that automatically activates in the event of a Christmas tree fire.

U.S. Pat. No. 5,040,610 to Blanchong discloses a fire extinguishing device which provides automatic actuation upon exposure to heat. The device includes a vessel composed of a polymeric material and includes an opening, a cap for closing the opening after a fire extinguishing medium is charged to the vessel, and a valve for pressurizing the vessel after the opening has been closed. The amount of pressure in the vessel and the composition of the fire extinguishing medium and the polymeric material are controlled so that, when the vessel is exposed to heat and/or flame, a portion of the vessel near the heat fails, creating a second opening in the vessel, in the vicinity of the portion of the vessel which was exposed to the heat. Unfortunately, this prior art example fails to provide a means of disguising the fire extinguishing elements to not distract from the festive tree decorations.

U.S. Pat. No. 6,003,610 to Kordes discloses a fire extinguishing system for a Christmas tree including a hollow base for maintaining a tree in a vertical orientation. Further provided is a pair of linear rigid lower extinguisher tubes. At least one flexible extinguisher tube is also included with a lower end and an upper end positioned adjacent a top end of the Christmas tree, wherein an intermediate extent of each flexible extinguisher is wrapped about the trunk of the Christmas tree. Further provided is at least one fire extinguisher situated within the interior space of the base containing fire extinguishing material. The fire extinguisher is connected to the extinguisher tubes and is adapted to excrete the fire extinguishing material through out the Christmas tree upon the actuation thereof. Such actuation is afforded via a fire sensor electrically connected to a power supply and the fire extinguisher for effecting the activation of the fire extinguisher upon the detection of a temperature above a predetermined amount. Unfortunately, this prior art example fails to provide a means of preventing fire damage to an area surrounding the Christmas tree.

Accordingly, a need remains for a Christmas tree fire extinguishing device in order to overcome the above-noted shortcomings. The present invention satisfies such a need by providing a device that is convenient and easy to use, is durable in design, is versatile in its applications, and effectively reduces the likelihood of fire damage to an existing Christmas tree and surrounding objects.

BRIEF SUMMARY OF THE INVENTION

In view of the foregoing background, it is therefore an object of the present invention to provide an apparatus for reducing a likelihood of fire damage to an existing Christmas tree and surrounding objects. These and other objects, features, and advantages of the invention are provided by a Christmas tree fire extinguishing device.

A Christmas tree fire prevention device for reducing a likelihood of fire damage to an existing Christmas tree and surrounding objects preferably includes an air-pressurized reservoir which may be adapted to be removably positioned at a base of the existing Christmas tree. Such an air-pressurized reservoir may be suitably sized and shaped for simulating a gift-wrapped present. In this manner, a benefit is provided to users who would otherwise not desire to place a bulky, bright-red fire extinguisher in the mix of an often elaborate and expensive holiday arrangement. Further, a fire-retardant agent may be maintained at an initial compressed state by the air-pressurized reservoir.

The fire prevention device may also include a mechanism for automatically discharging the fire-retardant agent along a diverging target path preferably when an unsafe triggering event is detected. Such a target path may begin at an apex of the existing Christmas tree and terminate at the base of the existing Christmas tree. Dispensing the fire-retardant at the apex allows the device to fully cover the interior of the tree as well as the surrounding area where fire is most likely to reach.

In addition, the unsafe triggering event may be detected when a real-time ambient temperature level surrounding the existing Christmas tree elevates beyond a predefined maximum threshold temperature level. The automatic fire-retardant agent discharging mechanism may further be adapted to be camouflaged and removably attached to the existing Christmas tree. In one embodiment, the discharging mechanism may take the shape of a star or angel to be placed atop the tree.

The automatic fire-retardant agent discharging mechanism may further include a flexible hose preferably having opposed lower and upper ends coupled to the reservoir and adapted to be positioned at the apex of the existing Christmas tree respectively. The flexible hose allows the user to easily position the discharging mechanism at the apex of the tree as the hose may easily bend and wrap through the thick branches of the tree.

Additionally, the discharging mechanism may include a valve. Such a valve preferably has an axial bore formed therein and may be directly connected to the upper end of the hose. The axial bore may be in fluid communication with the upper end of the hose. Further, an agitator may be journaled about the valve and partially seated within the axial bore. Such an agitator may have a plurality of spring-actuated cutting blades situated within the axial bore and further may have a plurality of fans radially spaced exterior of the valve. In addition, the discharging mechanism may include a guard covering the agitator and the valve respectively. Also, the fire-retardant agent may be maintained at a pressurized state within the hose and the axial bore during non-operating conditions.

The fire-retardant agent may be upwardly urged through the hose and the axial bore when the triggering-event is detected. Thereafter, the fire-retardant agent may be dispersed by the fans while traveling down the target path after reaching an upper limit of the guard. In operation, when a high level of heat or fire alerts the device, fire-retardant is ejected from the hose through the valve into the guard and directed downward along the target path to cover the tree and surrounding area.

The automatic fire-retardant agent discharging mechanism further may include a plug centrally aligned within the axial bore and extending above a top end of the valve such that the plug terminates at a location above the axial bore and beneath an apex of the guard respectively. The plug may include a tubular body formed from a metal-alloy. The plug operates to prevent the pressurized fire-retardant from ejecting through the valve before the triggering event has been detected.

Also, the discharging mechanism may include a bladder seated within the axial bore. Such a bladder may be frictionally intercalated between an outer surface of the plug and an inner surface of the axial bore respectively. Further, the discharging mechanism may include a plurality of elastic bands, each preferably having first ends anchored to a top end of the plug. The plurality of elastic bands may further include the second ends thereof coupled to the spring-actuated cutting blades of the agitator respectively. Such elastic bands may be maintained at a helically tensioned arrangement wound about the plug during non-operating conditions.

The plug preferably has a melting-temperature equal to the maximum threshold temperature level. Additionally, the plug may maintain direct frictional contact with the bladder inside the axial bore. This operates such that an upper end of the axial bore preferably remains blocked to thereby prevent the fire-retardant agent from prematurely egressing from the valve during non-operating conditions.

The discharging mechanism may further include at least the top end of the plug being adapted from a solid state to a liquid state when the real-time ambient temperature level rises above the maximum threshold temperature level.

In one embodiment, the plug may be a bismuth alloy. One skilled in the art understands that various bismuth alloys may be employed by the present invention without departing from its true scope. For example, an exemplary bismuth alloy, such as bismite (bismuth oxide, $Bi_2O_3$), has a low melting point, sometimes even below the temperature of boiling water. This bismuth-alloy casting can be covered by plastic or other material to form the plug used in the present invention. The bismuth-alloy core is then adapted to a liquid state when it melts in heated air, thereby unplugging the discharging valve and permitting the pressurized fire-retardant substance to egress along the travel path.

Further, the elastic bands may be released from the helically tensioned arrangement to an unwound relaxed arrangement when the top end of the plug melts. This may then radially release the spring-actuated cutting blades towards a center of the axial bore while contemporaneously permitting the agitator to rotate about the valve respectively. In addition, the bladder may be punctured and deflated by the spring-actuating cutting blades as the agitator rotates, thereby releasing the frictional contact from the plug so that an upwardly exerting force from the air-pressurized reservoir may eject the plug outwardly from the axial bore. The fire-retardant agent may freely egress from the axial bore and ricochet off an interior wall of the guard, preferably down along the target path for covering the existing Christmas tree.

In this manner, a user need not be present if a fire occurs. The heat of the flames will melt the top of the plug causing the elastic bands to unwind and spin the agitator; thereafter, the spinning blades will cut and deflate the bladder, releasing the plug, and ejecting the retardant over the tree. A user's Christmas decorations and home may be protected by the device at all times when the discharging mechanism is placed atop the tree.

The Christmas tree fire prevention device further may include a mechanism for automatically emitting an alarm signal when the automatic fire-retardant agent discharging mechanism is activated. This allows bystanders to be notified of the detected unsafe triggering event. Upon activation, the automatic alarm signal emitting mechanism may be independently and simultaneously operable from the automatic fire-retardant agent discharging mechanism. This operates such that the alarm signal is continuously emitted after the fire-retardant agent is depleted from the air-pressurized reservoir while the real-time ambient temperature level is above the maximum threshold temperature level. This may notify a user from a distance that a dangerous condition may still be present even after the device has discharged all of the fire-retardant.

The automatic alarm signal emitting mechanism may further include a power source. Such a power source may be a standard alkaline battery coupled to the automatic alarm signal, thereby allowing the alarm signal to be activated even if a power outage were present. Also, a temperature-detecting controller may be electrically coupled to the power source and arranged in such a manner to detect the real-time ambient temperature level surrounding the existing Christmas tree.

The automatic alarm signal emitting mechanism may further include a transducer. Such a transducer may be electrically coupled to the power source and the temperature-detecting controller respectively. In one embodiment, such a transducer may include a speaker to emit a high-pitched alarm combined with a set of flashing lights to visually warn those nearby.

Additionally, the maximum threshold temperature level may be programmed into the temperature-detecting controller. The temperature-detecting controller may generate and transmit a control signal to the transducer when the real-time ambient temperature level is detected above the maximum threshold temperature level. The transducer may receive the control signal and subsequently generate and continuously emit the alarm signal independent of an operating mode of the fire-retardant agent discharging mechanism.

Additionally, the present invention may include a method for reducing a likelihood of fire damage to an existing Christmas tree and surrounding objects. Such a method may include the first step of providing and removably positioning an air-pressurized reservoir at a base of the existing Christmas tree. The air-pressurized reservoir may be suitably sized and shaped for simulating a gift-wrapped present, thereby allowing it to blend in with the holiday decorations. A second step of the method preferably includes providing a fire-retardant agent. Next, the method preferably includes a third step of the air-pressurized reservoir maintaining the fire-retardant agent at an initial compressed state.

The method may further include a fourth step of providing and camouflaging an automatic fire-retardant agent discharging mechanism. Fifth, the method preferably includes removably attaching the automatic fire-retardant agent discharging mechanism to the existing Christmas tree and the air-pressurized reservoir respectively. A sixth step of the method may be detecting an unsafe triggering event by determining when a real-time ambient temperature level surrounding the existing Christmas tree elevates beyond a predefined maximum threshold temperature level. Finally, a seventh step of the method preferably includes discharging the fire-retardant agent along a diverging target path when the unsafe triggering event is detected. The target path may begin at an apex of the existing Christmas tree and terminate at the base of the existing Christmas tree to thereby cover the areas most commonly in danger of fire.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
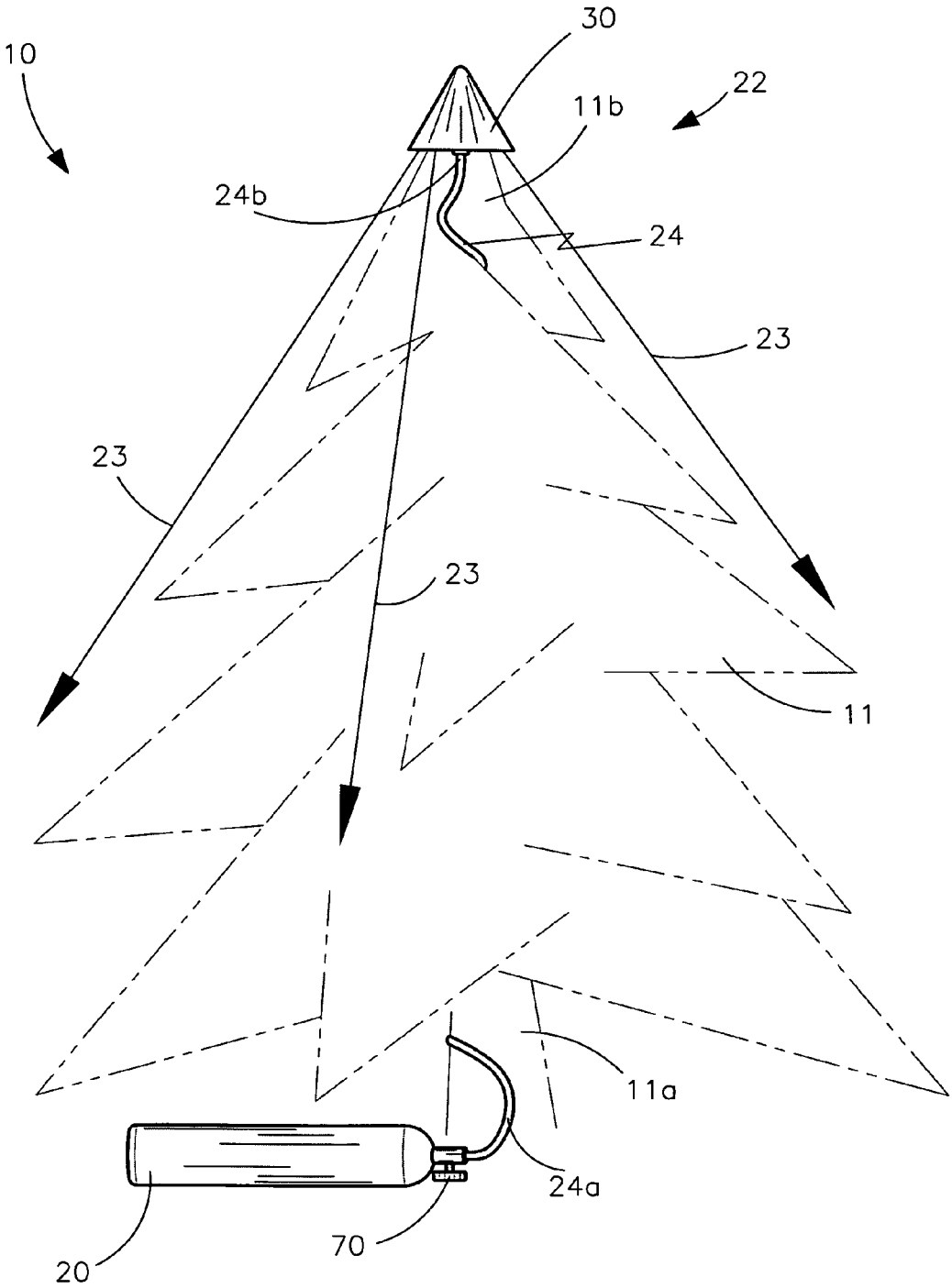
FIG. 1 is a front elevational view of a Christmas tree fire prevention device showing an air-pressurized reservoir situated at a base of an existing Christmas tree and a mechanism for automatically discharging the fire-retardant agent along a diverging target path, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-7 by the reference numeral 10 and is intended to provide a Christmas tree fire prevention device. It should be understood that the apparatus 10 may be used to reduce the likelihood of fire damage to many different types of areas and should not be limited in use to the applications mentioned herein. For example, the user may install the device in a kitchen or a child's play room.

Figure 2:
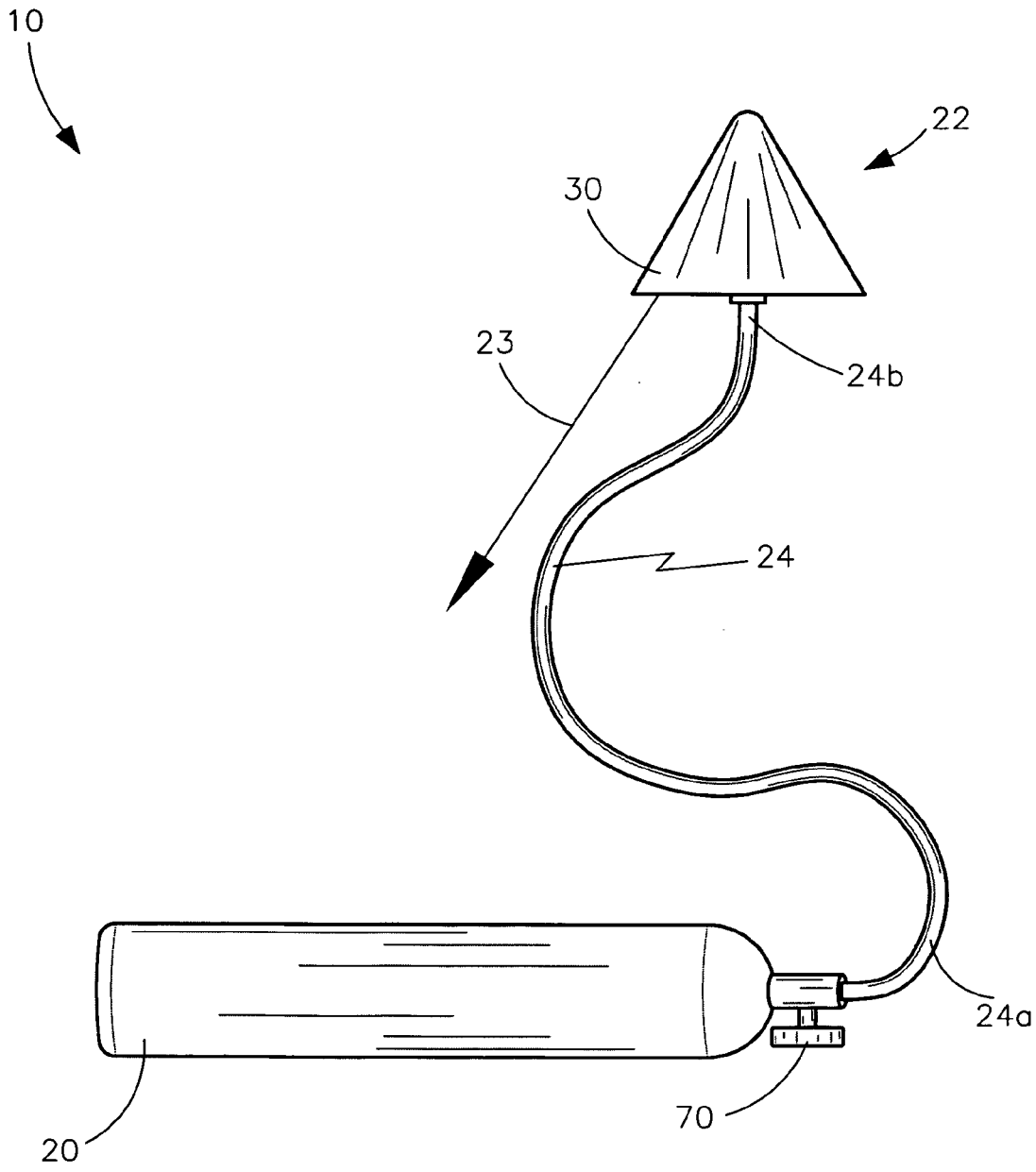
FIG. 2 is a front elevational view showing the automatic fire-retardant agent discharging mechanism isolated from the existing Christmas tree.

Referring initially to FIGS. 1, 2, a Christmas tree fire prevention device 10 for reducing a likelihood of fire damage to an existing Christmas tree 11 and surrounding objects preferably includes an air-pressurized reservoir 20 which may be adapted to be removably positioned at a base 11A of the existing Christmas tree 11. Such an air-pressurized reservoir 20 may be suitably sized and shaped for simulating a gift-wrapped present. Of course, the air-pressurized reservoir 20 may also be conveniently sized and shaped for simulating a number of different objects. In this manner, an unexpected benefit is provided to users who would otherwise not desire to place a bulky, bright-red fire extinguisher among an often elaborate and expensive holiday arrangement.

Referring to FIGS. 1, 2, 3, and 5, the reservoir 20 may also contain a fire-retardant agent 21. Such a fire-retardant agent 21 may be maintained at an initial compressed state by the air-pressurized reservoir 20. The air-pressurized reservoir may include a manual shut off valve 70 which is important for activating and deactivated the device 10. The fire prevention device 10 may also include a mechanism 22 for automatically discharging the fire-retardant agent along a diverging target path 23 when an unsafe triggering event is detected. Such a target path 23 may begin at an apex 11B of the existing Christmas tree and terminate at the base 11A of the existing Christmas tree.

Dispensing the fire-retardant 21 at the apex 11B allows the automatic fire-retardant agent discharging mechanism 22 to cover a major surface area of the existing Christmas tree 11 as well as the surrounding area where fire is most likely to reach. In this manner, the user avoids the risk of a quick-spreading fire growing beyond the tree and consuming surrounding structures. The unsafe triggering event may be detected when a real-time ambient temperature level surrounding the existing Christmas tree 11 elevates beyond a predefined maximum threshold temperature level.

The automatic fire-retardant agent discharging mechanism 22 may further be adapted to be camouflaged and removably attached to the existing Christmas tree 11. In one embodiment of the present invention, the discharging mechanism 22 may take the shape of a star or angel to be placed atop the Christmas tree 11 and add to the holiday feel. Alternately, the discharging mechanism 22 may have a natural color scheme including green or brown colors to blend into the tree 11 itself.

Referring to FIGS. 1, 2, the automatic fire-retardant agent discharging mechanism 22 may further include a flexible hose 24 preferably having opposed lower 24A and upper ends 24B coupled to the reservoir 20 and adapted to be positioned at the apex 11B of the existing Christmas tree 11 respectively. The combined elements of the flexible hose 24 and the removably attached automatic fire-retardant agent discharging mechanism 22 provide an unexpected benefit wherein a user may advantageously conceal the elements separately in or around the Christmas tree 11. In this manner, the user may easily position the discharging mechanism 22 at the apex 11B and easily bend and wrap the flexible hose 24 through the branches of the tree 11, thereafter connecting the hose 24 to the reservoir 20 at the base 11A.

Referring to FIGS. 3, 4, 5A, 5B, 6A and 6B, the discharging mechanism 22 may include a valve 25. Such a valve 25 preferably includes an axial bore 26 formed therein and may be directly connected, without the use of intervening elements, to the upper end 24B of the flexible hose 24. The axial bore 26 may also be in fluid communication with the upper end 24B of the hose 24. Further, an agitator 27 may be journaled about the valve 25 and partially seated within the axial bore 26. Such an agitator 27 may have a plurality of spring-actuated cutting blades 28 situated within the axial bore 26 and further may have a plurality of fans 29 radially spaced exterior of the valve 25.

The discharging mechanism 22 may include a guard 30 covering the agitator 27 and the valve 25 respectively. Also, the fire-retardant agent 21 may be maintained at a pressurized state within the hose 24 and the axial bore 26 during non-operating conditions. The fire-retardant agent 21 may be upwardly urged through the hose 24 and the axial bore 26 when the triggering-event is detected. Thereafter, the fire-retardant agent 21 may be dispersed by the fans 29 while traveling down the target path 23 after reaching an upper limit of the guard 30. In operation, when an elevated air-temperature from heat or fire alerts the device, fire-retardant 21 is ejected from hose 24 through the valve 25 into the guard 30 and directed downward along the target path 23 to cover the tree 11 and surrounding area.

Figure 3:
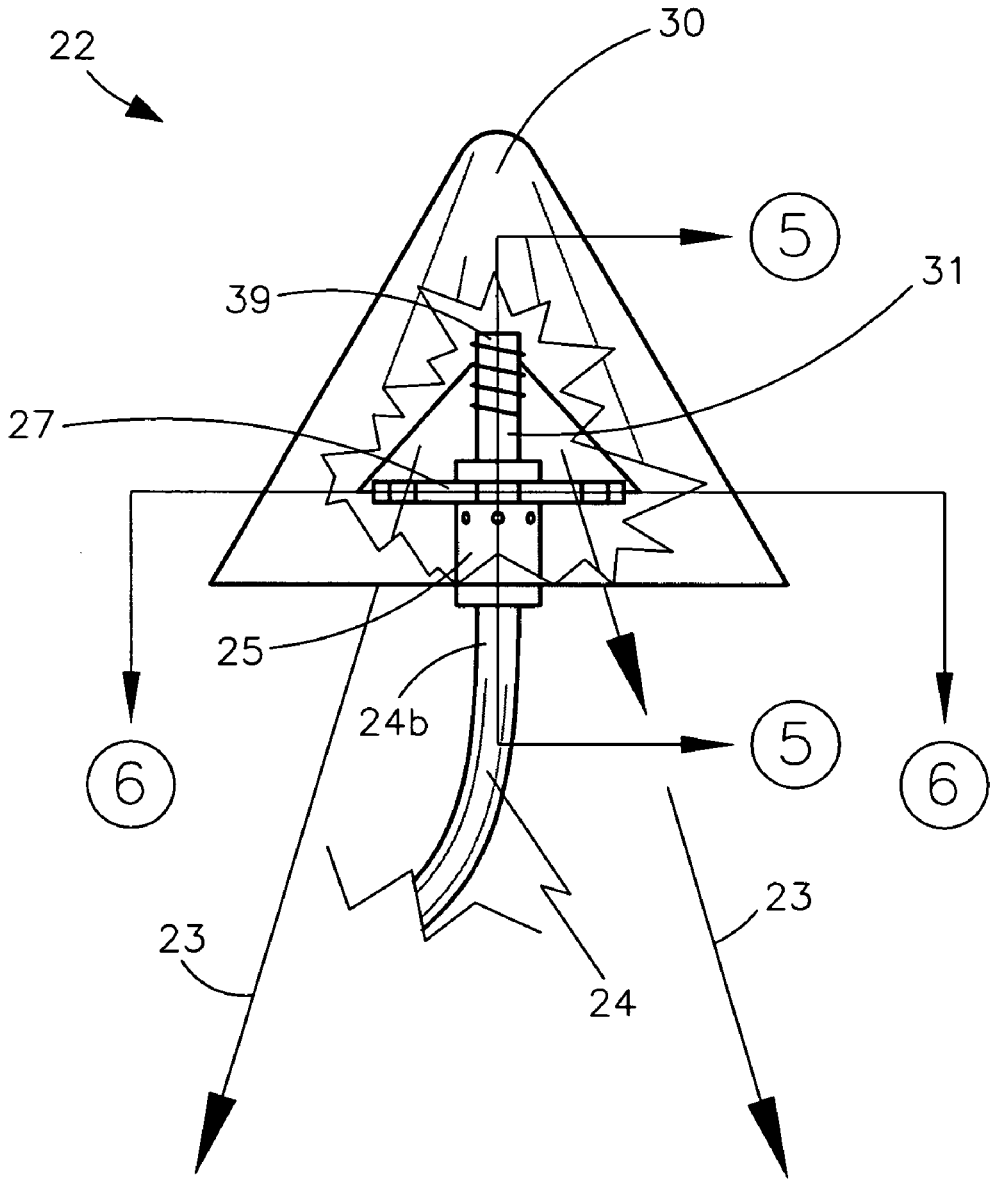
FIG. 3 is an enlarged break-away view showing the interrelationship between the valve, agitator, and metal-alloy plug employed by the automatic fire-retardant agent discharging mechanism.
Figure 4:
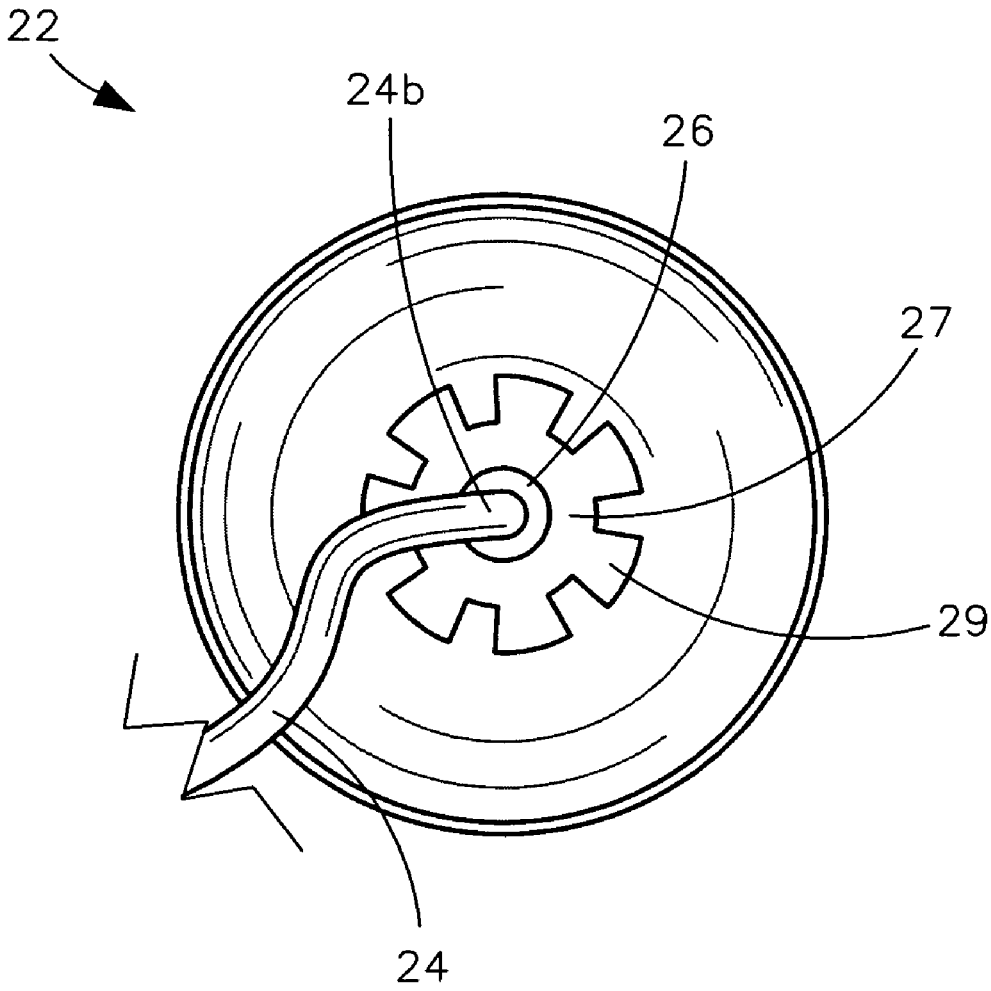
FIG. 4 is an enlarged bottom plan view showing the hose connected to the valve with the guard positioned thereabout.
Figure 5A:
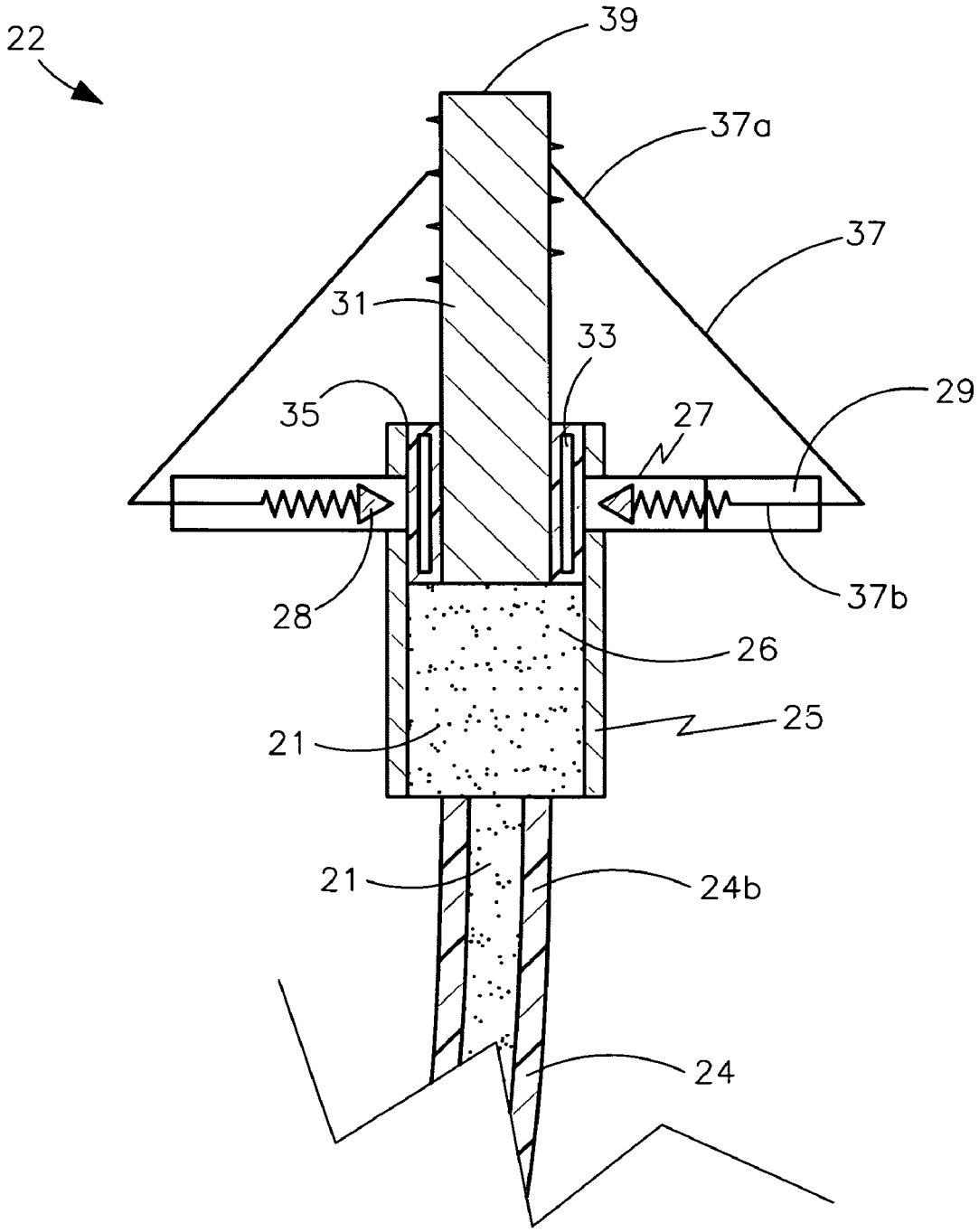
FIG. 5*a* is an enlarged cross-sectional view of the automatic fire-retardant agent discharging mechanism showing the spring-actuated blades in a retracted position and the air bladder at an inflated mode, taken along line 5-5, as seen in FIG. 3.
Figure 5B:
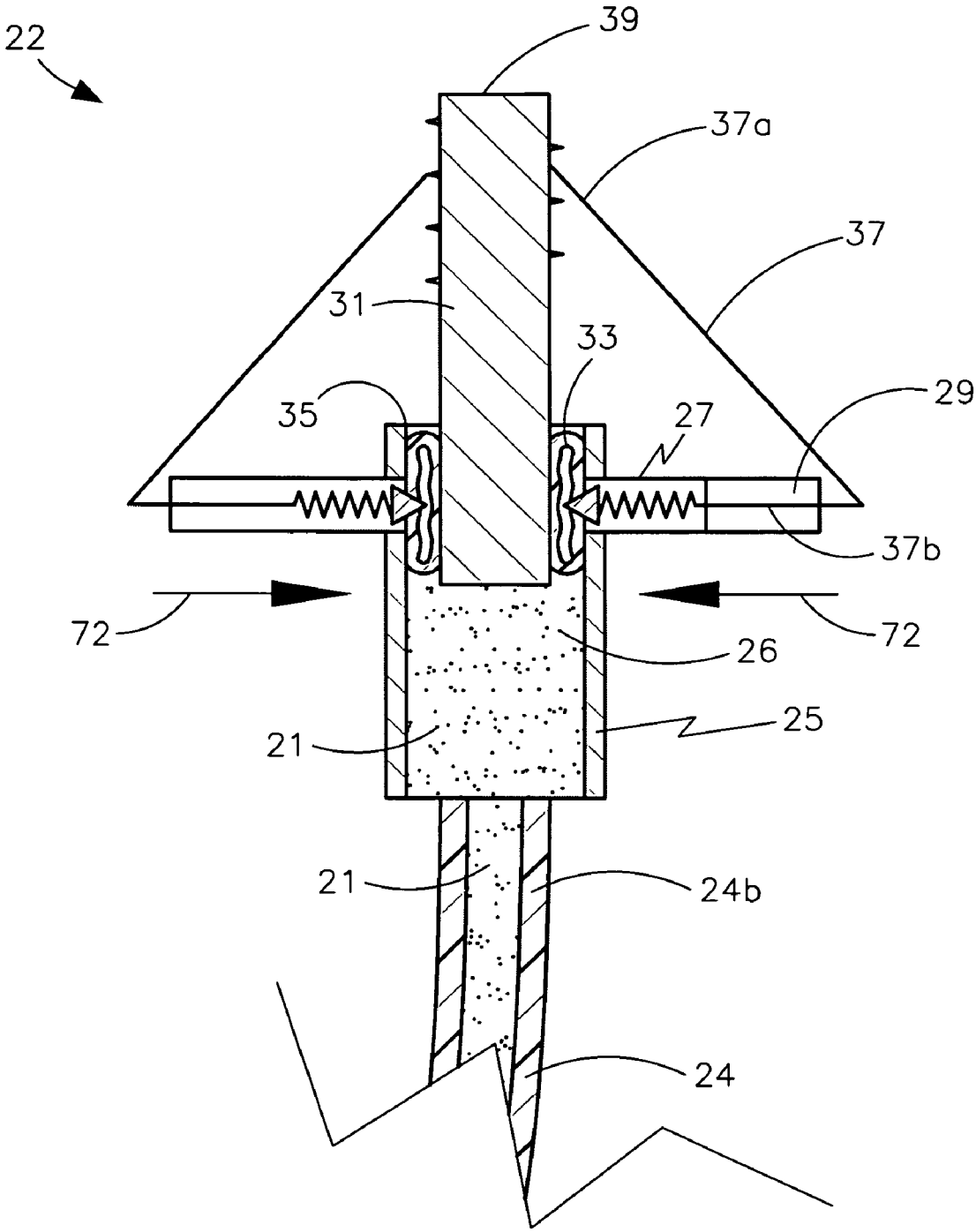
FIG. 5*b* is an enlarged cross-sectional view of the automatic fire-retardant agent discharging mechanism showing the spring-actuated blades in an extended position and penetrating through the deflated air bladder.

Referring to FIGS. 3, 5A, and 5B, the automatic fire-retardant agent discharging mechanism 22 further may include a plug 31 centrally aligned within the axial bore 26 and extending above a top end of the valve 25 such that the plug 31 terminates at a location above the axial bore 26 and beneath an apex of the guard 30 respectively. The plug 31 may include a tubular body formed from a metal-alloy. The plug 31 operates to prevent the pressurized fire-retardant 21 from prematurely ejecting through the valve 25 before the triggering event has been detected. This feature ensures the device 10 may be installed on the Christmas tree 11 without prematurely dispersing the fire retardant 21 during normal atmospheric temperatures.

Referring to FIGS. 5A, 5B, 6A, and 6B, the discharging mechanism 22 may include a bladder 33 seated within the axial bore 26. Such a bladder 33 may be frictionally intercalated between an outer surface of the plug 31 and an inner surface 35 of the axial bore 36 respectively. Further, the discharging mechanism 22 may include a plurality of elastic bands 37, each preferably having first ends 37A anchored to a top end 39 of the plug 31. The second ends 37B of plurality of elastic bands 37 may be coupled to the spring-actuated cutting blades 28 of the agitator 27 respectively. Such elastic bands 37 may be maintained at a helically tensioned arrangement wound about the plug 31 during non-operating conditions.

It should be noted that reference numeral 37 may refer to both the plurality of elastic bands and a single elastic band interchangeably. Further, reference numerals 37A and 37B may refer to both the first and second ends of the plurality of elastic bands and the first and second end of a single band, respectively.

The plug 31 preferably has a melting-temperature equal to the maximum threshold temperature level. Additionally, the plug 31 may maintain direct frictional contact with the bladder 33 inside the axial bore 26. This operates such that an upper end 26B of the axial bore 26 preferably remains blocked to thereby prevent the fire-retardant agent 21 from prematurely egressing from the valve 25 during non-operating conditions. Of course, one skilled in the art may select alternate metal-alloys that have a suitable melting temperature, as needed.

Referring again to FIGS. 5A, 5B, 6A, and 6B, the discharging mechanism 22 may further include at least the top end 39 of the plug 31 being adapted from a solid state to a liquid state when the real-time ambient temperature level rises above the maximum threshold temperature level. The plug 31 maintains its solid state when the real-time ambient temperature level is below the maximum threshold level. This is vital so that the automatic fire-retardant agent discharging mechanism 22 does not prematurely activate when a heat source nominally raises the air temperature. In this manner, the user may position the discharging mechanism 22 adjacent a strand of decorative heat-emitting incandescent lights on a Christmas tree 11. Thus, the user is not forced to compromise a holiday decoration scheme in order to employ the present invention.

In one embodiment, the plug may be a bismuth alloy. One skilled in the art understands that various bismuth alloys may be employed by the present invention without departing from its true scope. For example, an exemplary bismuth alloy, such as bismite (bismuth oxide, $Bi_2O_3$) may be employed herein. Such a bismuth alloy has a low melting point, sometimes even below the temperature of boiling water. Thus, a bismuth-alloy casting can be covered by plastic or other material to form the plug used in the present invention. A bismuth-alloy core is then adapted to a liquid state when it melts at sufficiently elevated temperatures, thereby unplugging the discharging valve 25 and permitting the pressurized fire-retardant agent 21 to egress along the target path 23.

The discharging mechanism 22 may further include the elastic bands 37 being released from the helically tensioned arrangement to an unwound relaxed arrangement when the top end 39 of the plug 31 melts. This may then radially release the spring-actuated cutting blades 28 towards a center of the axial bore 26 along mutually exclusive linear paths 72 while contemporaneously permitting the agitator 27 to rotate in a circular path 71 about the valve 25 respectively.

Figure 6A:
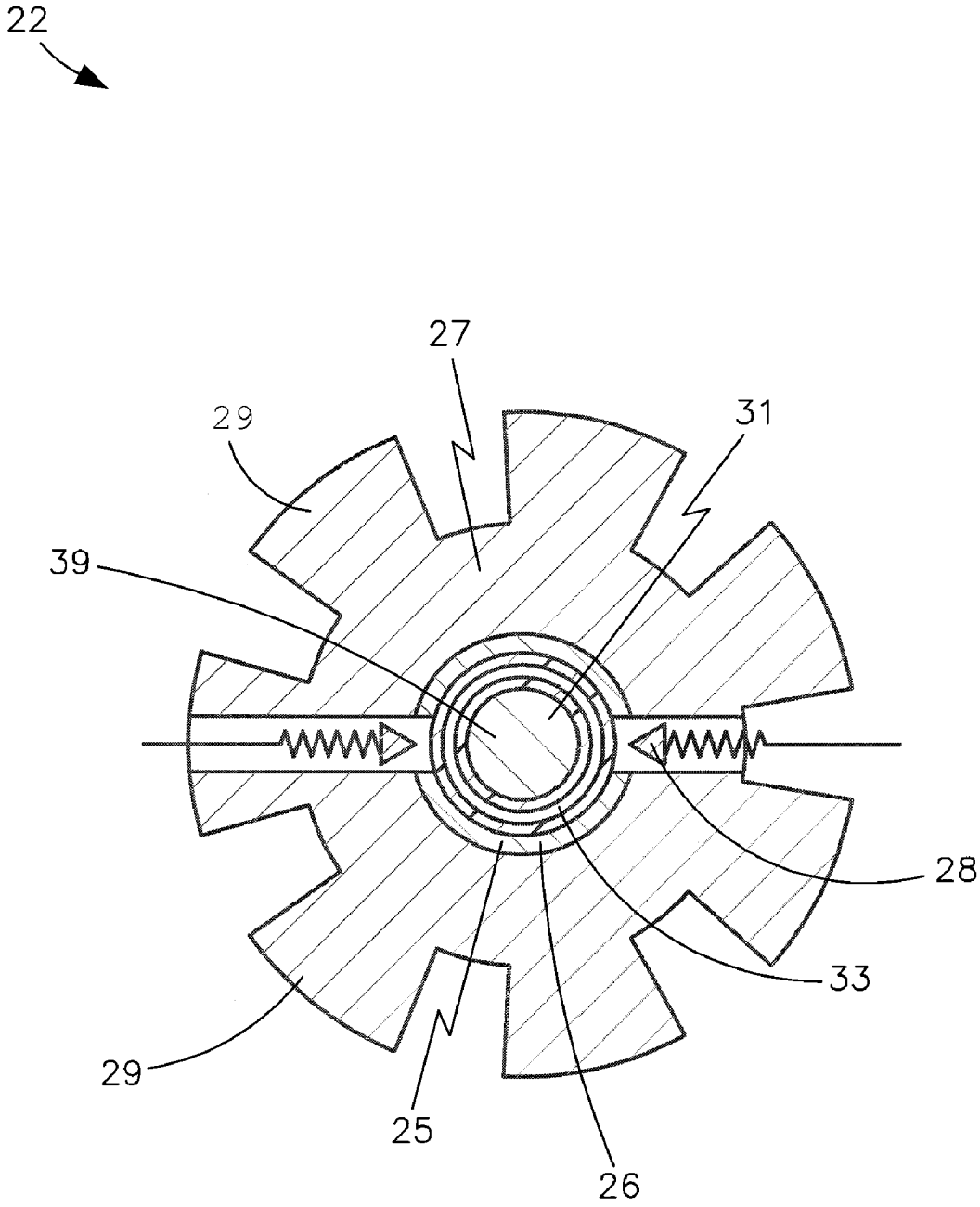
FIG. 6*a* is a cross sectional view of the automatic fire-retardant agent discharging mechanism showing the spring-actuated blades in a retracted position and the air bladder at an inflated position, taken along line 6-6, as seen in FIG. 3.
Figure 6B:
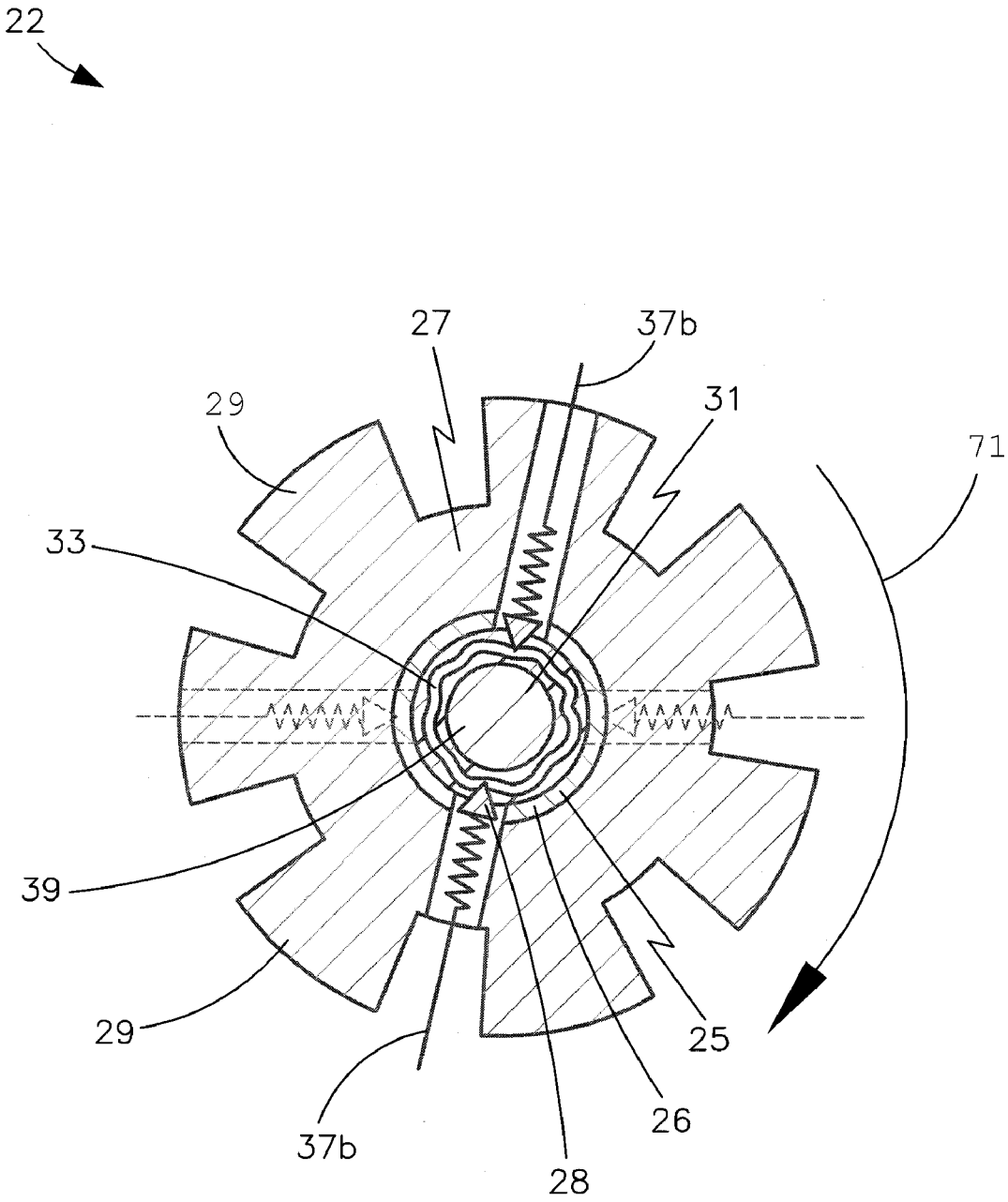
FIG. 6*b* is an enlarged cross-sectional view, taken along line 6-6, showing the rotational movement of the agitator as the cutting blades pierce and deflate the bladder.

Referring, in particular, to FIGS. 5B and 6B, the bladder 33 may be punctured and deflated by the spring-actuating cutting blades 28 as the agitator 27 rotates, thereby releasing the frictional contact from the plug 31 so that an upwardly exerting force from the air-pressurized reservoir 20 may eject the plug 31 outwardly from the axial bore 26. The fire-retardant agent 21 may freely egress from the axial bore 26 and ricochet off an interior wall of the guard 30, preferably down along the target path 23 for covering the existing Christmas tree 11.

In this manner, a user need not be present if a fire occurs. The heat of the flames will melt the top of the plug 31 causing the elastic bands 37 to unwind and rotate the agitator 27; thereafter, the blades 28 will cut and deflate the bladder 33, releasing the plug 31, and discharge the fire retardant 21 over the Christmas tree 11. Thus, use of this device 10 ensures that a user's decorations and home may be protected from imminent fire damage at all times.

Figure 7:
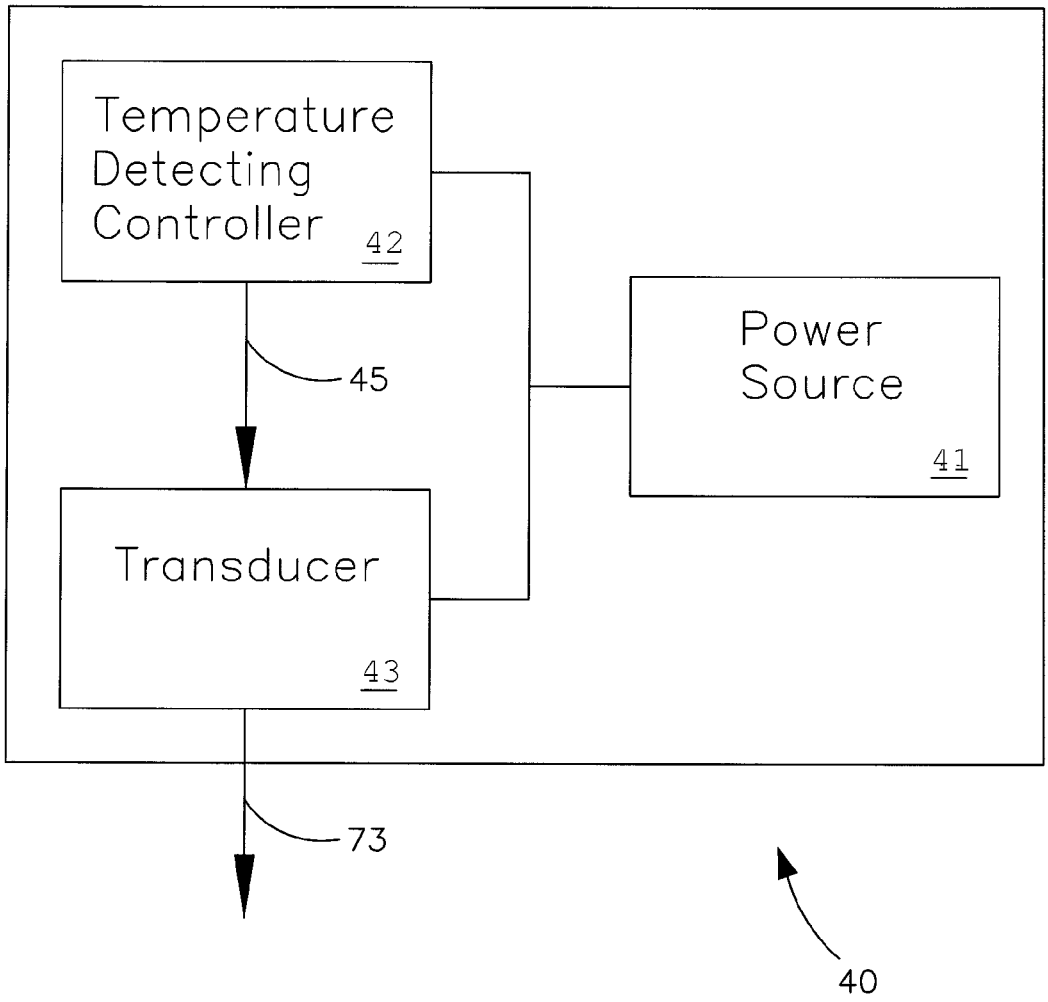
FIG. 7 is a high-level schematic block diagram showing the interrelationship between the major electrical components of the automatic alarm signal emitting mechanism, in accordance with the present invention.

Referring to FIG. 7, the Christmas tree fire prevention device 10 further may include a mechanism 40 for automatically emitting an alarm signal when the automatic fire-retardant agent discharging mechanism 22 is activated. The combined elements of the automatic alarm signal emitting mechanism 40 and the automatic fire-retardant agent discharging mechanism 22 provide an unexpected benefit wherein the device 10 not only prevents fires from spreading and extinguishes fires but also warns users of the dangerous conditions. This feature overcomes the problems of prior art examples which only either extinguished the flames or produce an alarm, when the sprinkler is working.

Upon activation, the automatic alarm signal emitting mechanism 40 may be independently and simultaneously operable from the automatic fire-retardant agent discharging mechanism 22. This operates such that the alarm signal is continuously emitted after the fire-retardant agent 21 is depleted from the air-pressurized reservoir 20 while the real-time ambient temperature level is above the maximum threshold temperature level. This may notify the user from a distance that a dangerous condition may still be present even after the device has discharged all fire-retardant agent.

The automatic alarm signal emitting mechanism 40 may further include a power source 41. Such a power source 41 may be a standard alkaline battery coupled to the automatic alarm signal, thereby allowing the alarm signal to be activated even if a power outage were present. Also, a temperature-detecting controller 42 may be electrically coupled to the power source 41 and arranged in such a manner to detect the real-time ambient temperature level surrounding the existing Christmas tree 11.

Referring to FIG. 7, the automatic alarm signal emitting mechanism 40 may further include a transducer 43 electrically coupled to the power source 41 and the temperature-detecting controller respectively 42. In one embodiment, such a transducer 43 may include a speaker to emit a high-pitched alarm combined with a set of flashing lights to visually warn those nearby. The combined elements of the alarm signal emitting mechanism 40 and the transducer 43 preferably includes a set of flashing lights that provide an unexpected benefit wherein hearing impaired users may also be warned of the danger.

The maximum threshold temperature level may be programmed into the temperature-detecting controller 42. The temperature-detecting controller 42 may generate and transmit a control signal 45 to the transducer 43 when the real-time ambient temperature level is detected above the maximum threshold temperature level. The transducer 43 may receive the control signal 45 and subsequently generate and continuously emit the alarm signal 73 independent of an operating mode of the fire-retardant agent discharging mechanism 22.

In use, a method for reducing a likelihood of fire damage to an existing Christmas tree and surrounding objects may include the first step providing and removably positioning an air-pressurized reservoir at a base of the existing Christmas tree. The air-pressurized reservoir may be suitably sized and shaped for simulating a gift-wrapped present, thereby allowing it to blend in with the holiday decorations. A second step of the method preferably includes providing a fire-retardant agent. Next, the method may include a third step of the air-pressurized reservoir maintaining the fire-retardant agent at an initial compressed state.

The method may further include a fourth step of providing and camouflaging an automatic fire-retardant agent discharging mechanism. Thereafter, the method preferably includes a fifth step of removably attaching the automatic fire-retardant agent discharging mechanism to the existing Christmas tree and the air-pressurized reservoir respectively. A sixth step of the method may be detecting an unsafe triggering event by determining when a real-time ambient temperature level surrounding the existing Christmas tree elevates beyond a predefined maximum threshold temperature level. Finally, a seventh step of the method preferably includes discharging the fire-retardant agent along a diverging target path when the unsafe triggering event is detected. The target path may begin at an apex of the existing Christmas tree and terminate at the base of the existing Christmas tree to thereby cover the areas most commonly in danger of fire.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A Christmas tree fire prevention device for reducing a likelihood of fire damage to an existing Christmas tree and surrounding objects, said Christmas tree fire prevention device comprising:

an air-pressurized reservoir adapted to be removably positioned at a base of the existing Christmas tree;

a fire-retardant agent maintained at an initial compressed state by said air-pressurized reservoir;

means for automatically discharging said fire-retardant agent along a diverging target path when an unsafe triggering event is detected, said target path beginning at an apex of the existing Christmas tree and terminating at the base of the existing Christmas tree;

wherein said unsafe triggering event is detected when a real-time ambient temperature level surrounding the existing Christmas tree elevates beyond a predefined maximum threshold temperature level;

wherein said automatic fire-retardant agent discharging means is adapted to be camouflaged and removably attached to the existing Christmas tree;

wherein said automatic fire-retardant agent discharging means comprises a flexible hose having opposed lower and upper ends coupled to said reservoir and adapted to be positioned at the apex of the existing Christmas tree respectively;

a valve having an axial bore formed therein and being directly connected to said upper end of said hose, said axial bore being in fluid communication with said upper end of said hose;

an agitator journaled about said valve and partially seated within said axial bore, said agitator having a plurality of spring-actuated cutting blades situated within said axial bore and further having a plurality of fans radially spaced exterior of said valve; and a guard covering said agitator and said valve respectively;

wherein said fire-retardant agent is maintained at a pressurized state within said hose and said axial bore during non-operating conditions, said fire-retardant agent being upwardly urged through said hose and said axial bore when said triggering-event is detected, said fire-retardant agent being subsequently dispersed by said fans while traveling down said target path after reaching an upper limit of said guard.

2. The Christmas tree fire prevention device of claim 1, wherein said automatic fire-retardant agent discharging means further comprises:

a plug centrally aligned within said axial bore and extending above a top end of said valve such that said plug terminates at a location above said axial bore and beneath an apex of said guard respectively;

a bladder seated within said axial bore, said bladder being frictionally intercalated between an outer surface of said plug and an inner surface of said axial bore respectively; and a plurality of elastic bands each having first ends anchored to a top end of said plug and further having second ends coupled to said spring-actuated cutting blades of said agitator respectively, said elastic bands maintained at a helically tensioned arrangement wound about said plug during non-operating conditions;

wherein said plug has a melting-temperature equal to said maximum threshold temperature level.

3. The Christmas tree fire prevention device of claim 2, wherein said plug maintains direct frictional contact with said bladder inside said axial bore such that an upper end of said axial bore remains blocked and thereby prevents said fire-retardant agent from prematurely egressing from said valve during non-operating conditions.

4. The Christmas tree fire prevention device of claim 3, wherein at least said top end of said plug is adapted from a solid state to a liquid state when the real-time ambient temperature level rises above said maximum threshold temperature level;

wherein said elastic bands are released from said helically tensioned arrangement to an unwound relaxed arrangement when said top end of said plug melts and thereby radially release said spring-actuated cutting blades towards a center of said axial bore while contemporaneously permitting said agitator to rotate about said valve respectively;

wherein said bladder is punctured and deflated by said spring-actuating cutting blades as said agitator rotates and thereby releases the frictional contact from said plug so that an upwardly exerting force from said air-pressurized reservoir ejects said plug outwardly from said axial bore;

wherein said fire-retardant agent freely egresses from said axial bore and ricochets off an interior wall of said guard down along said target path for covering the existing Christmas tree.

5. The Christmas tree fire prevention device of claim 4, wherein said plug comprises: a tubular body formed from a metal-alloy.

6. The Christmas tree fire prevention device of claim 1, further comprising:

means for automatically emitting an alarm signal when said automatic fire-retardant agent discharging means is activated such that bystanders are notified of the detected unsafe triggering event;

wherein upon activation said automatic alarm signal emitting means is independently and simultaneously operable from said automatic fire-retardant agent discharging means such that said alarm signal is continuously emitted after said fire-retardant agent is depleted from said air-pressurized reservoir while the real-time ambient temperature level is above the maximum threshold temperature level.

7. The Christmas tree fire extinguishing device of claim 6, wherein said automatic alarm signal emitting means comprises:

a power source;

a temperature-detecting controller electrically coupled to said power source and arranged in such a manner to detect the real-time ambient temperature level surrounding the existing Christmas tree; and a transducer electrically coupled to said power source and said temperature-detecting controller respectively;

wherein said maximum threshold temperature level is programmed into said temperature-detecting controller, said temperature-detecting controller generating and transmitting a control signal to said transducer when the real-time ambient temperature level is detected above the maximum threshold temperature level;

wherein said transducer receives said control signal and subsequently generates and continuously emits said alarm signal independent of an operating mode of said fire-retardant agent discharging means.

8. A Christmas tree fire prevention device for reducing a likelihood of fire damage to an existing Christmas tree and surrounding objects, said Christmas tree fire prevention device comprising:

an air-pressurized reservoir adapted to be removably positioned at a base of the existing Christmas tree, said air-pressurized reservoir being suitably sized and shaped for simulating a gift-wrapped present;

a fire-retardant agent maintained at an initial compressed state by said air-pressurized reservoir;

means for automatically discharging said fire-retardant agent along a diverging target path when an unsafe triggering event is detected, said target path beginning at an apex of the existing Christmas tree and terminating at the base of the existing Christmas tree;

wherein said unsafe triggering event is detected when a real-time ambient temperature level surrounding the existing Christmas tree elevates beyond a predefined maximum threshold temperature level;

wherein said automatic fire-retardant agent discharging means is adapted to be camouflaged and removably attached to the existing Christmas tree;

wherein said automatic fire-retardant agent discharging means comprises:

a flexible hose having opposed lower and upper ends coupled to said reservoir and adapted to be positioned at the apex of the existing Christmas tree respectively;

a valve having an axial bore formed therein and being directly connected to said upper end of said hose, said axial bore being in fluid communication with said upper end of said hose;

an agitator journaled about said valve and partially seated within said axial bore, said agitator having a plurality of spring-actuated cutting blades situated within said axial bore and further having a plurality of fans radially spaced exterior of said valve; and a guard covering said agitator and said valve respectively;

wherein said fire-retardant agent is maintained at a pressurized state within said hose and said axial bore during non-operating conditions, said fire-retardant agent being upwardly urged through said hose and said axial bore when said triggering-event is detected, said fire-retardant agent being subsequently dispersed by said fans while traveling down said target path after reaching an upper limit of said guard.

9. The Christmas tree fire prevention device of claim 8, wherein said automatic fire-retardant agent discharging means further comprises:

a plug centrally aligned within said axial bore and extending above a top end of said valve such that said plug terminates at a location above said axial bore and beneath an apex of said guard respectively;

a bladder seated within said axial bore, said bladder being frictionally intercalated between an outer surface of said plug and an inner surface of said axial bore respectively; and a plurality of elastic bands each having first ends anchored to a top end of said plug and further having second ends coupled to said spring-actuated cutting blades of said agitator respectively, said elastic bands maintained at a helically tensioned arrangement wound about said plug during non-operating conditions;

wherein said plug has a melting-temperature equal to said maximum threshold temperature level.

10. The Christmas tree fire prevention device of claim 9, wherein said plug maintains direct frictional contact with said bladder inside said axial bore such that an upper end of said axial bore remains blocked and thereby prevents said fire-retardant agent from prematurely egressing from said valve during non-operating conditions.

11. The Christmas tree fire prevention device of claim 10, wherein at least said top end of said plug is adapted from a solid state to a liquid state when the real-time ambient temperature level rises above said maximum threshold temperature level;

wherein said elastic bands are released from said helically tensioned arrangement to an unwound relaxed arrangement when said top end of said plug melts and thereby radially release said spring-actuated cutting blades towards a center of said axial bore while contemporaneously permitting said agitator to rotate about said valve respectively;

wherein said bladder is punctured and deflated by said spring-actuating cutting blades as said agitator rotates and thereby releases the frictional contact from said plug so that an upwardly exerting force from said air-pressurized reservoir ejects said plug outwardly from said axial bore;

wherein said fire-retardant agent freely egresses from said axial bore and ricochets off an interior wall of said guard down along said target path for covering the existing Christmas tree.

12. The Christmas tree fire prevention device of claim 11, wherein said plug comprises: a tubular body formed from a metal-alloy.

13. The Christmas tree fire prevention device of claim 8, further comprising:

means for automatically emitting an alarm signal when said automatic fire-retardant agent discharging means is activated such that bystanders are notified of the detected unsafe triggering event;

wherein upon activation said automatic alarm signal emitting means is independently and simultaneously operable from said automatic fire-retardant agent discharging means such that said alarm signal is continuously emitted after said fire-retardant agent is depleted from said air-pressurized reservoir while the real-time ambient temperature level is above the maximum threshold temperature level.

14. The Christmas tree fire extinguishing device of claim 13, wherein said automatic alarm signal emitting means comprises:

a power source;

a temperature-detecting controller electrically coupled to said power source and arranged in such a manner to detect the real-time ambient temperature level surrounding the existing Christmas tree; and a transducer electrically coupled to said power source and said temperature-detecting controller respectively;

wherein said maximum threshold temperature level is programmed into said temperature-detecting controller, said temperature-detecting controller generating and transmitting a control signal to said transducer when the real-time ambient temperature level is detected above the maximum threshold temperature level;

wherein said transducer receives said control signal and subsequently generates and continuously emits said alarm signal independent of an operating mode of said fire-retardant agent discharging means.

* * * * *